United States Patent [19]

Kappler

[11] 3,937,007

[45] Feb. 10, 1976

[54] COMBUSTION CHAMBER AND PROCESS UTILIZING A PREMIX CHAMBER OF A POROUS CERAMIC MATERIAL

[75] Inventor: Gunter Kappler, Munich, Germany

[73] Assignee: Motoren- und Turbinen-Union Munchen GmbH, Germany

[22] Filed: May 28, 1974

[21] Appl. No.: 474,026

[30] Foreign Application Priority Data

May 25, 1973 Germany ..... 2326680

[52] U.S. Cl. ..... 60/39.06; 60/39.65; 60/39.69; 60/39.71; 60/39.74 R; 431/352; 239/145

[51] Int. Cl.[2] ..... F02C 7/22

[58] Field of Search..... 60/39.65, 39.71, 39.74 R, 60/39.06, 39.69; 431/351, 352; 239/145

[56] References Cited

UNITED STATES PATENTS

| | | | |
|---|---|---|---|
| 3,187,799 | 6/1965 | Nesbitt | 431/352 X |
| 3,368,604 | 2/1968 | Mutchler | 431/352 X |
| 3,810,732 | 5/1974 | Koch | 431/328 |

FOREIGN PATENTS OR APPLICATIONS

| | | | |
|---|---|---|---|
| 1,932,881 | 8/1970 | Germany | 60/39.74 |

*Primary Examiner*—William L. Freeh
*Assistant Examiner*—Robert E. Garrett
*Attorney, Agent, or Firm*—Craig & Antonelli

[57] ABSTRACT

Combustion chamber apparatus and process for use in gas turbine engines including a premix chamber bounded by porous ceramic material and a combustion chamber immediately adjacent a porous ceramic diaphragm which bounds the premix chamber. In this premix chamber, partial vaporization of the fuel, without combustion, takes place so as to improve combustion efficiency and shorten the length of the flame tube or combustion chamber needed for complete efficient combustion of the fuel. Primary air is introduced into the premix chamber, which passes with the fuel into the flame tube or combustion chamber, for futher mixture with secondary and tertiary air.

5 Claims, 1 Drawing Figure

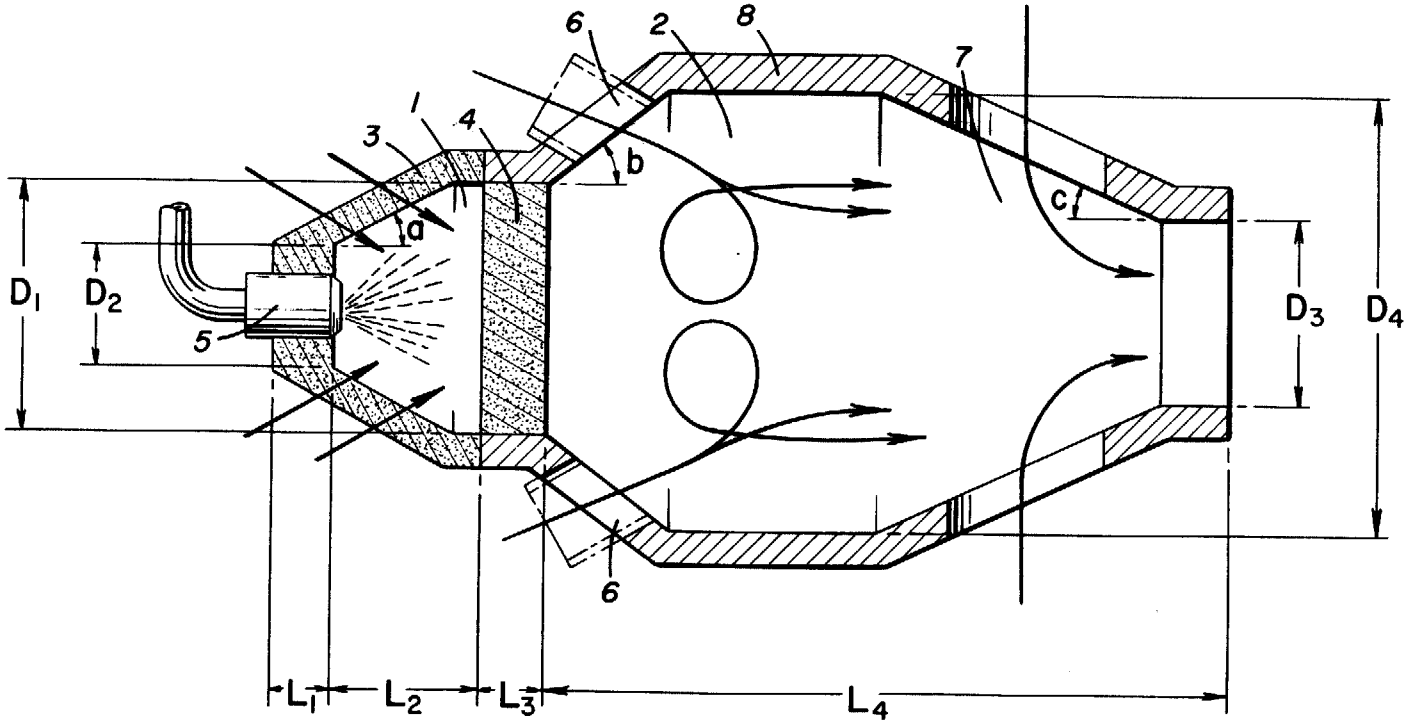
D4
D3
c
7
8
2
6
b
4
1
3
a
5
D2
D1
L4
L3
L2
L1

COMBUSTION CHAMBER AND PROCESS UTILIZING A PREMIX CHAMBER OF A POROUS CERAMIC MATERIAL

BACKGROUND AND SUMMARY OF THE INVENTION

The present invention relates to a combustion chamber and process for use in gas turbines.

Combustion chambers for gas turbines are known in which the fuel is injected directly at the upstream end of the flame tube. With these combustion chambers the mixture is not satisfactorily conditioned on account of, chiefly, insufficient atomization of the fuel, of poor mixing with the combustion air, and of insufficient heating of the fuel. Inadequate atomization of the fuel causes relatively heavy emission of injurious matter and environmental contamination. Also, the turbine inlet temperature profiles of these combustion chambers are exceedingly inconsistent and thus detrimental to the useful life of the blades. With again other, known combustion chambers, vaporizer tubes are used in lieu of direct injection. While these vaporizer tubes provide more perfectly conditioned mixtures than will direct injection, they still fail to give entire satisfaction owing to their more narrowly restricted operating range and the low temperatures that these vaporizer tubes will be able to sustain because they are made of nickel alloy.

Practically all known combustion chambers have in common flame tubes generally made of sheet, where use is made of certain nickel alloys as a material. Inasmuch as these materials will not safely sustain temperatures of more than 1300°K, with combustion temperatures running far above, these flame tubes need intensive cooling to prevent their destruction and achieve the long useful life essential to economical operation. However, low wall temperatures resulting from such intensive cooling greatly promotes the formation of soot, which often settles on the cool walls near the nozzle where it impairs the combustion efficiency and frequently occasions malfunctions.

A broad aspect of the present invention is to provide a combustion chamber which, while economizing the cost of manufacture, improves combustion, reduces the emission of injurious matter and promotes favorable turbine inlet temperatures profiles by, particularly, raising the ceiling on wall temperatures and improving the fuel conditioning process.

It is a particular object of the present invention to provide a combustion chamber in which the fuel is conditioned, and mixed with the primary air needed to sustain combustion, in an entirely permeably walled premix chamber attached to the upstream end of the flame tube, and in which combustion occurs, immediately after the mixture issues from the premix chamber, in a combustion zone beginning directly at the intervening diaphragm. In this mixing chamber, partial vaporization of the fuel provides more perfectly conditioned fuel than could be achieved in the previously known combustion chambers, which in turn improves combustion efficiency, shortens the length of flame and considerably improves the resultant temperature profile over previously known temperature profiles. The reduction in the length of combustion zone will naturally also affect to advantage the over-all length of the combustion chamber.

In a further apsect of the present invention, the premix chamber is made of a porous ceramic sinter material enabling it to safely sustain elevated wall temperatures as high as 2000°C, which will in turn provide still more perfectly conditioned fuel and which, most importantly, will prevent the formation and deposition of soot.

In a further aspect of the present invention the premix chamber consists of two parts of which one is an approximately frustum-shaped head member incorporating an opening for the fuel nozzle and of which the other is a disk-shaped diaphragm through which the combustible mixture enters the combustion zone.

This arrangement considerably simplifies the manufacture of the premix chamber and, more particularly, it prevents the thermal stresses which would otherwise be induced in the ceramic components as a result of the elevated temperatures of the diaphragm. Also very importantly, it considerably economizes the cost of manufacture and permits the materials and porosities to be varied between the two components.

In a still further aspect of the present invention the flame tube downstream of the premix chamber incorporates a stepped flare and exhibits inwardly inclined passageways for secondary air. This enables the supply of secondary air at points in close proximity to the combustion zone, without major pressure losses, and in an approximately axial direction with a radial component.

BRIEF DESCRIPTION OF THE DRAWINGS

The single drawing FIGURE illustrates a combustion chamber arranged in accordance with the present invention.

DETAILED DESCRIPTION OF THE DRAWING

The direction of flow of the working medium is indicated by arrowheads. The compressed air enters the combustion chamber from the left, with a portion of the air, or the primary air 1, forcing its way through the permeable walls 3 of the premix chamber 1 at the upstream end and the remaining air flowing past the premix chamber 1 to enter the flame tube 8 directly for duty as secondary 2 (through openings 6) or tertiary air (through openings 7).

Fuel is injected, through a fuel injector nozzle 5, into the premix chamber where it is atomized and extensively mixed with the primary air 1, in which process a portion of the fuel vaporizes but combustion is still prevented. A portion of the fuel may optionally be allowed to retain its droplet form. The fuel/air mixture then flows into the combustion zone (of flame tube 8) through the pores of the very hot ceramic diaphragm 4. In transit through this hot diaphragm 4, the still remaining fuel also vaporizes, so that the mixture entering the combustion zone of flame tube 8 may be burned to form an exhaust gas maximally free from residue despite a very short flame. The oxygen needed for complete combustion is carried laterally towards the combustion zone of flame tube 8 through the passageways 6 for secondary air, which also operate to create a recirculation zone which assists stabilization, attemperation and a reduction in the length of the combustion zone. The tertiary air is admixed in a mixing zone adjacent openings 7 to reduce temperatures.

By way of example and not by way of limitation, the following preferred dimensions are given for the combustion chamber arrangement illustrated in the drawings:

| | |
|---|---|
| $D_1$ — 40mm | a — 30° |
| $D_2$ — 25mm | b — 30° |
| $D_3$ — 60mm | c — 30-45° |
| $D_4$ — 90mm | |
| L1 — 10mm | |
| L2 — 50mm | |
| L3 — 10mm | |
| L4 — 160mm | |

In the preferred arrangement illustrated, eight openings for secondary air 2 are equally spaced around a circumference, with each having a diameter of 18mm. Eight openings for tertiary air 7 are also provided equally spaced around the circumference, with each having a diameter of 25mm.

The wall thicknesses of all outer walls vary between 3 and 6mm with the plate or diaphragm 4 which divides the premix and combustion chamber being 10mm thick as indicated above. The porosity of the ceramic sinter materials (percentage of the area open to the air flow in relation to the total area) should be approximately 30% for all outer walls and 70% for the plate or diaphragm dividing the premix and combustion chamber.

Preferred materials for the ceramic sinter materials for the porous walls of the premix chamber are:

a. "Saffil" on the basis of aluminum oxyde, as made by the British firm "Imperial Chemical Industries — Mond Devision", London.

b. "Saffil" on the basis of circonium oxyde, made by the same firm.

c. "Recristallised Silicon Carbide NC400", made by the British firm "Advanced Materials Engineering" Gateshead, England.

These specific dimensional and material examples given herein are included only to aid in providing an enabling disclosure for those skilled in the art to practice the invention, and and it is not in any way intended to limit the scope of the claims attached hereto. The particular dimensions of the chambers and the flaring of the combustion or flame tube wall portions disclosed herein provide optimum operation of the combustion chamber.

Obviously, many modifications and variations of the present invention are possible in the light of the above teachings. It should therefore be understood that within the scope of the appended claims, the invention may be practiced otherwise than as specifically described.

I claim:

1. Combustion chamber for use in gas turbines, comprising a flame tube, a premix chamber located at the upstream end of the flame tube, and fuel injector means for injecting fuel directly into said premix chamber, wherein the premix chamber comprises an entirely permeably walled chamber which includes an intervening diaphragm attached to the upstream end of the flame tube, wherein combustion occurs, immediately after the mixture issues from the premix chamber, in a combustion zone beginning directly at the intervening diaphragm.

2. Combustion chamber of claim 1, further characterized in that the walls of the premix chamber are made of a porous ceramic sinter material.

3. Combustion chamber of claim 2, further characterized in that the walls of the premix chamber consist of two parts of which one is an approximately frustum-shaped head member incorporating an opening to accommodate said fuel injector means and of which the other is the diaphragm having a disk shape through which the combustible mixture reaches the combustion zone.

4. Combustion chamber of claim 3, further characterized in that the flame tube downstream of the premix chamber and in the combustion chamber incorporates a stepped flare and exhibits inwardly inclined passageways for secondary air.

5. Combustion process for gas turbines comprising:

conditioning fuel by directly injecting and mixing the fuel with primary air needed to sustain combustion in an entirely permeably walled premix chamber attached to an upstream end of a flame tube, passing the conditioned fuel and primary air mixture through a permeable wall of the premix chamber into the flame tube, and effecting the combustion of the mixture issuing from the premix chamber in the flame tube immediately upon passage of the same through the permeable wall separating the premix chamber and the flame tube.

* * * * *